United States Patent [19]

Boyer et al.

[11] Patent Number: 4,741,168

[45] Date of Patent: May 3, 1988

[54] COOLING PROCESS AND TUNNEL

[75] Inventors: Bernard Boyer, Sassenage; Louis Giacinti, Claix; Jean-Yves Thonnelier, Sassenage, all of France

[73] Assignee: L'Air Liquide, Societe Anonyme pour l'Etude et l'Exploitation des Procedes Georges Claude, Paris, France

[21] Appl. No.: 15,862

[22] PCT Filed: Jun. 4, 1986

[86] PCT No.: PCT/FR86/00192

§ 371 Date: Jan. 21, 1987

§ 102(e) Date: Jan. 21, 1987

[87] PCT Pub. No.: WO86/07440

PCT Pub. Date: Dec. 18, 1986

[30] Foreign Application Priority Data

Jun. 11, 1985 [FR] France ..... 85 08777

[51] Int. Cl.[4] ..... F25D 13/06

[52] U.S. Cl. ..... 62/63; 62/374

[58] Field of Search ..... 62/63, 373, 374

[56] References Cited

U.S. PATENT DOCUMENTS

| | | | |
|---|---|---|---|
| 1,651,858 | 12/1927 | Wilkinson | 62/382 |
| 2,237,255 | 4/1941 | Finnegan | 62/63 |
| 2,552,832 | 5/1951 | Ahlstrand et al. | 62/62 |
| 2,885,864 | 5/1959 | Benjamin | 62/51 |
| 3,412,573 | 11/1968 | Pauliukonis | 62/374 |
| 3,738,121 | 6/1973 | Swindell | 62/378 |

FOREIGN PATENT DOCUMENTS

| | | |
|---|---|---|
| 0065896 | 3/1983 | European Pat. Off. . |
| 2854990 | 11/1979 | Fed. Rep. of Germany . |
| 2088148 | 1/1972 | France . |
| 2349110 | 11/1977 | France . |
| 2398274 | 2/1979 | France . |

*Primary Examiner*—Ronald C. Capossela

*Attorney, Agent, or Firm*—Young & Thompson

[57] ABSTRACT

The tunnel comprises a tube (1) in which are stacked parts (A) to be cooled, and an intermediate chamber (7) which surrounds the tube and around which is disposed a heat exchanger (3). Liquid nitrogen is vaporized upwardly in the exchanger, redescends in the chamber (7) and rises in the tube (1). The supply of liquid nitrogen is controlled by a temperature probe (17). Application in the cold fitting of parts in the mechanical industry.

24 Claims, 2 Drawing Sheets

COOLING PROCESS AND TUNNEL

The present invention relates to a cooling process and tunnel and more particularly applies to the cooling of a succession of individual parts adapted for example to be fitted in other elements in the cold state.

It is known to cool parts for contracting them before they are fitted. As the use of a refrigerating unit does not permit the obtainment of temperatures lower than −60° C., which is often insufficient, it has been proposed to dip the parts into a cryogenic liquid such as liquid nitrogen.

However, this process is expensive, as it consumes large quantities of liquid nitrogen, the refrigerating properties of which are not used in an optimum manner.

An object of the invention is to provide a cooling apparatus whereby it is possible to obtain a wide range of cooling temperatures with a reduced consumption of cryogenic liquid.

The invention therefore provides a cooling process comprising forming a column of material to be cooled in a tube which is open at its upper end; cooling this column by vaporization of a cryogenic liquid outside said tube and then injection of the resulting gas in the vicinity of the base of the column; causing said gas to flow upwardly in the tube; and progressively extracting the cooled material from the base of the tube by the effect of gravity.

The invention also provides a cooling tunnel for carrying out such a process. This tunnel comprises a tube having an upper opening for supplying material to be cooled and a lower opening for discharging the cooled material under the effect of gravity, and a heat exchanger coaxial with and located outside said tube, said exchanger comprising a conduit whose inlet end is connected to a source of cryogenic liquid and whose outlet end communicates through openings with the tube in the vicinity of its lower end.

An embodiment of the invention will now be described with reference to the accompanying drawings, in which.

Figure 1:
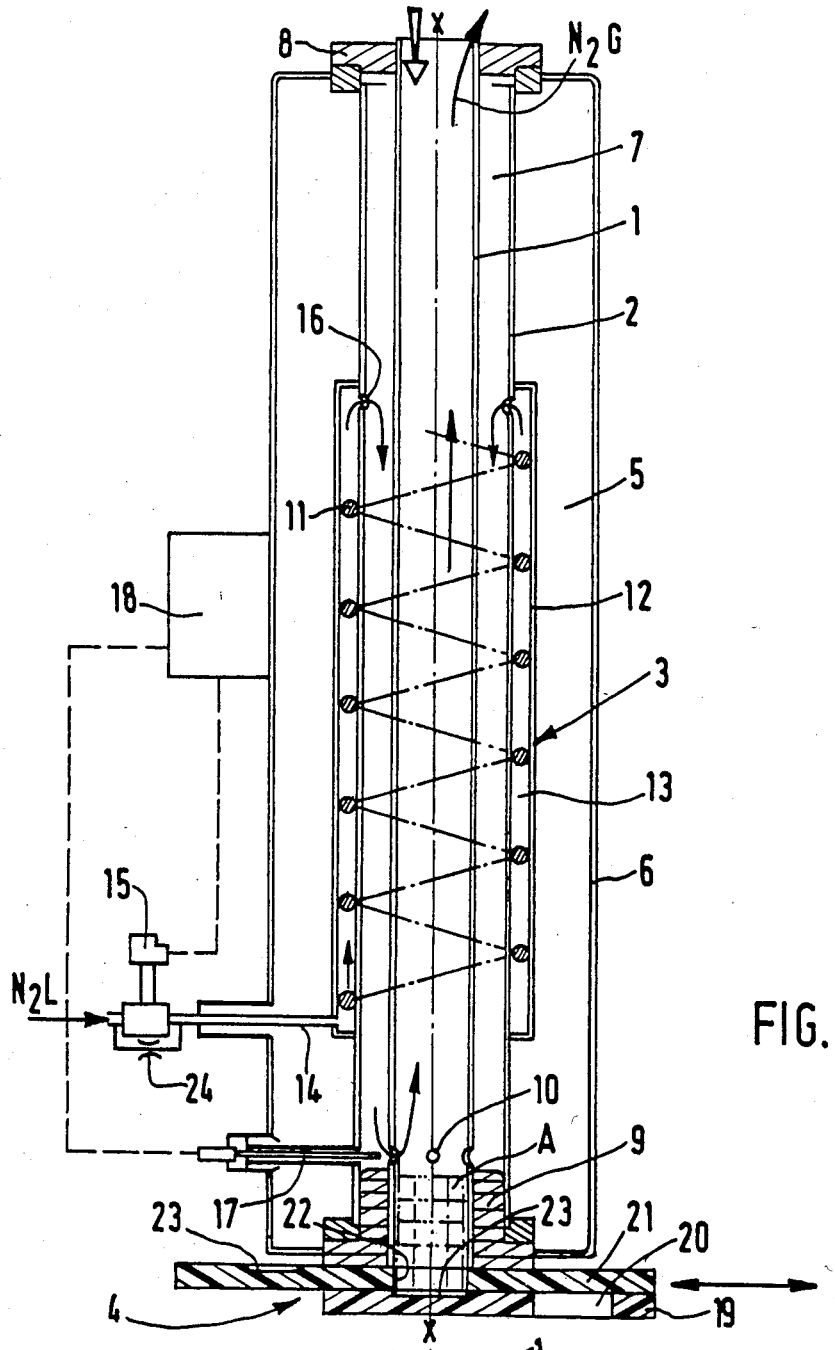
FIG. 1 is a vertical sectional view of a cooling tunnel according to the invention.

The tunnel shown in FIG. 1 is adapted to cool a succession of rings A, for example valve guides, adapted to be fitted in the cold state in the cylinder heads of motor vehicle engines. This tunnel, which has a general shape of revolution about a vertical axis X—X, comprises a central tube 1 surrounded by a second tube 2, a heat exchanger 3 disposed around the tube 2, a device 4 for closing the lower end of the tube 1, and a thermal insulation 5 contained in an outer case 6.

The tube 1, which is adapted to surround the rings A with a notable clearance, is open at both ends; it defines with the tube 2 an intermediate annular chamber 7 closed at both ends by a suitable upper plug 8 and a suitable lower plug 9, the latter being composed of a thermally insulating material. The tube 1 has a ring arrangement of orifices 10 located slightly above the plug 9.

The heat exchanger 3 is disposed in the median region of the tube 2 and extends a part of the length of the latter. It consists of a rod 11 helically wound around the tube 2 and gripped between the latter and a fluidtight housing 12. The rod 11 thus defines in the housing 12 a helical passage 13 whose lower end is connected to a liquid nitrogen supply conduit 14 which is controlled by an electrovalve 15, while the upper end of the passage 13 communicates with the chamber 7 through a ring arrangement of orifices 16.

The insulation 5 may be constituted by an insulating material, for example a foam of plastics material, which fills the space defined by the housing 12, the upper and lower parts of the tube 2 and the case 6.

A temperature probe 17 extends through the case 6, the insulation 5 and the tube 2 and enters the chamber 7 at the level of the orifices 10. This probe controls the opening or the closure of the electrovalve 15, as a function of the detected temperature, through a control box 18.

The closing device 4 is made from a plastics material and comprises a fixed horizontal plate 19 provided with an opening 20 offset from the axis X—X and a slide plate 21 which has a thickness equal to that of a ring A and is slidable between the plate 19 and the lower side of the plug 9 under the action of a jack (not shown). This slide plate defines an opening 22 which has, as the opening 20, a diameter substantially equal to the inside diameter of the tube 1; it is slidable between two positions, in one of which (FIG. 1) the opening 22 is in confronting relation to the tube 1 and to a solid region of the plate 19, whereas in the other position (FIG. 2), this opening is in vertical alignment with the opening 20.

In operation, the rings A are stacked flat in the tube 1 for roughly the whole of the height of the latter, and the electrovalve 15 is opened. The liquid nitrogen passes through the conduit 14 into the passage 13, vaporizes in the latter and enters in the gaseous form the intermediate chamber 7 through the orifices 16. In the chamber 7, the gaseous nitrogen is heated in giving up cold to the tube 1 and the rings A and flows downwardly. Thus, it is purely gaseous nitrogen which enters the tube 1 through the orifices 10, between the tube 1 and the rings A, rises therein while being progressively heated and is discharged through the upper end of the tube 1. When, as in the described embodiment, the parts to be cooled are rings, or more generally bored parts, it is advantageous to provide in the upper face of the slide 21 and/or the plate 19 grooving 23 which is, irrespective of the position of the slide, in vertical alignment with the tube 1 under the lower ring A and enables the nitrogen to enter the interior of the bores of the rings.

After a transitional cooling stage, the probe 17 detects a reference or set cold temperature and starts to provide a regulation of the supply of liquid nitrogen by an appropriate control of the electrovalve 15.

Thus, the rings A located in the bottom of the tube 1 are cooled down to the desired cold temperature, for example between −60° C. and −170° C. They are extracted one by one from the tunnel by alternately bringing the slide 21 into the position of FIG. 1 where a ring A drops into the opening 19, and into that of FIG. 2 where this ring falls through the opening 20 into a receiving device (not shown).

With the arrangement described hereinbefore, the heat of vaporization of the liquid nitrogen and the sensible heat of the gaseous nitrogen are used to the best effect for cooling the rings A. Further, the rising, descending and then rising path of the nitrogen achieves an effective cooling, in a countercurrent manner, of the stack of rings A while ensuring that there is no loss of liquid nitrogen through the closing device 4, since only the gaseous nitrogen enters the tube 1 through the orifices 10.

It should be noted that, when the electrovalve 15 is open, the rings A are maintained under a nitrogen atmosphere which avoids the presence of humidity or ice on these parts. In this respect, it is advantageous to provide the electrovalve with a throttled by-pass 24 for ensuring a permanent upward flow of nitrogen in the tube 1, even during the periods of closure of the electrovalve.

Thus, the apparatus is flexible, easily rendered automatic and produces with precision the desired fitting temperature with a reduced consumption of liquid nitrogen.

Note that, owing to the arrangement of the heat exchanger 3 outside the tube 2, it is possible to dispose in the latter different tubes 1 having cross-sections of various shapes and sizes adapted to the shapes and sizes of the parts to be cooled. In other words, the major part of the apparatus is standard for many applications.

In order to guarantee that the nitrogen is completely vaporized when it reaches the orifices 10, the chamber 7 may be filled with a loosely-packed type of lining (balls, "Dixxon" rings) or other lining (grating or netting, metallic sponge), or fins constituting baffles may be provided in this chamber. When this lining or these fins are composed of a thermally conductive material, they have the further advantage of improving the heat exchange between the nitrogen and the parts to be cooled.

Figure 2:
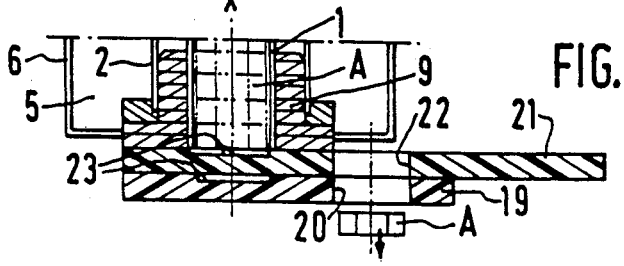
FIG. 2 is a similar view of the lower end of the tunnel, in another stage of its operation.

The tunnel shown in FIGS. 1 and 2 is more particularly adapted to the case where the thermal insulation 5 is not under a vacuum. Indeed, it is then possible to close the corresponding interwall space without causing a metal part to intervene by forming a thermal bridge between the lower end of the apparatus, which is at ambient temperature, and the place of the orifices 10, which is at the set low temperature.

Figure 3:
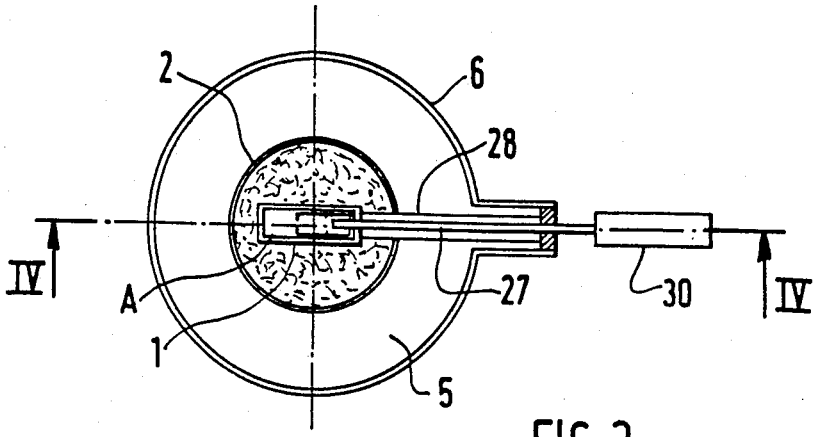
FIG. 3 is a cross-sectional view, taken on line III—III of FIG. 4, of another embodiment of the tunnel according to the invention.
Figure 4:
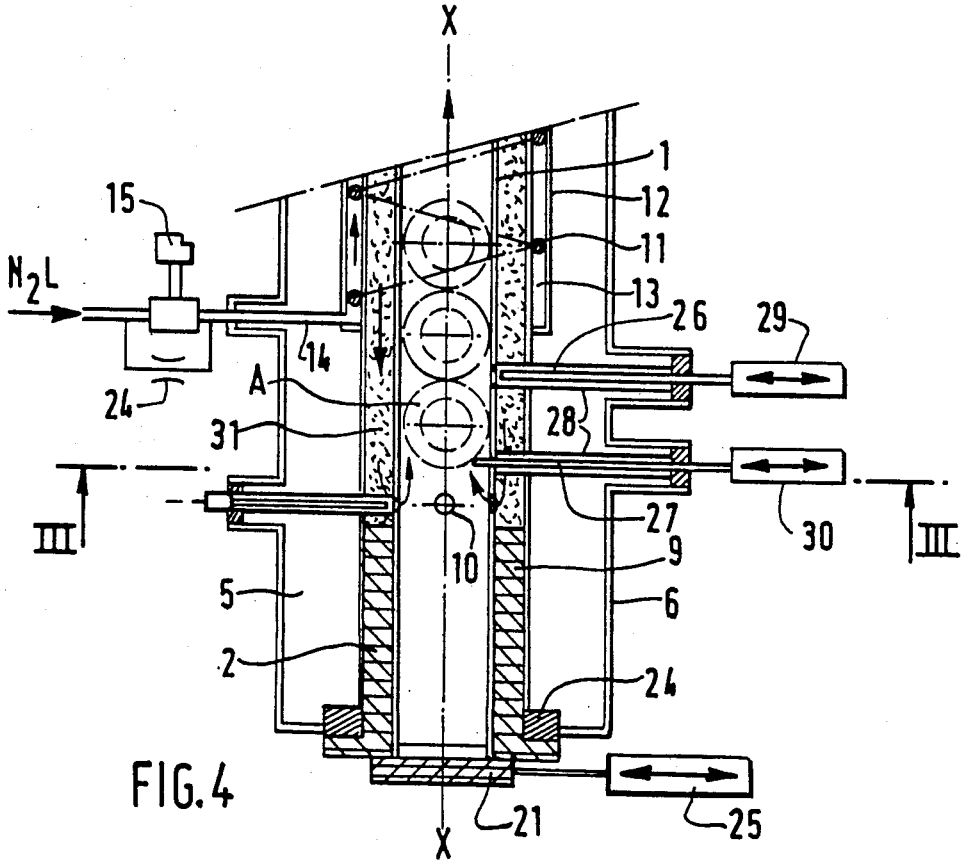
FIG. 4 is a longitudinal sectional view, taken on line IV—IV of FIG. 3, of the lower part of this tunnel.

In the case of an insulation 5 under a vacuum, it is preferable to arrange the lower part of the tunnel in the manner shown in FIGS. 3 and 4. The central tube 1 has a rectangular section for receiving a set of rings A standing on edge, while the tube 2 still has a circular section. The tubes 1 and 2 are extended downwardly through a substantial distance, for example 10 to 20 cm, below the orifices 10. The lower end of the tube 2 is connected by a ring 24 to the lower end of the outer case 6. As in FIGS. 1 and 2, the annular space defined between the tubes 1 and 2 is filled with a plug 9 of insulating material, for example a foam material, below the orifices 10. As a modification, the tube 1 may be terminated just below the orifices 10 and the lower end of the tube 1 may be engaged in the upper end of the plug 9, which is then shaped internally to the same section.

The slide 21 is solid and slides horizontally under the action of a jack 25, against the lower side of the plug 9. It merely serve to close the tube 1. To discharge the rings A one by one, there are provided an upper horizontal finger member 26 and a lower horizontal finger member 27 which are guided to slide horizontally in passageways 28 through the insulation 5 and actuated by respective jacks 29, 30. These two finger members are contained in the vertical plane of the rings A spaced apart to the extent of a diameter of a ring A, and the finger member 27 is located slightly above the orifices 10. The tube 1 has an orifice for the passage of each of the two finger members.

There has also been shown in FIGS. 3 and 4 the lining 31 referred to hereinbefore which fills the space between the tubes 1 and 2 and above the plug 9.

In the illustrated position, the slide 21 is closed; the lower finger member 27 penetrates the tube 1 while the upper finger member 26 is retracted and does not project into this tube. The column of rings A therefore bears against the finger member 27. The vaporized nitrogen enters the tube 1 through the orifices 10 just below the lower ring A and cools all the rings in a countercurrent manner.

To release the lower ring, the finger member 26 is extended and penetrates the tube 1 and retains the second ring. At the same time, or just after, the slide 21 is opened and the finger member 27 is retracted. The lower ring, cooled to the set temperature owing to its waiting position adjacent to the orifices 10, then drops out of the tunnel into an appropriate receiving device (not shown). Then the slide 21 is closed, the finger member 27 is extended and the finger member 26 retracted so that the column of rings descends one step and a new cycle is repeated. As will be understood, the whole of the operation may be easily rendered automatic.

In order to avoid an untimely drawing off of liquid nitrogen, a safety device closes the electrovalve 15 when the slide 21 is open.

In this embodiment, the heat losses are reduced owing to the remoteness of the orifices 10 from the outlet of the tunnel, and each ring is however maintained at the set cold temperature until it is discharged from the apparatus.

The invention is applicable to the cooling of various types of mechanical parts intended to be fitted in the cold state (valve guides and seats, gear pinions etc.) and may encompass the cooling of loose materials in bulk; in the latter case, the closing and retaining device 4 or 21-26-27 may be eliminated, the cooled material bearing against a heap contained in a suitable discharging receptacle connected in a sealed manner to the lower part of the outer case 6 or of the tube 1. It would also be possible, in the same case, to replace the closing and retaining device by a sealed metering device such as a rotary valve having cavities, although the device 4 shown in FIGS. 1 and 2 can also perform this function.

We claim:

1. A process for cooling material, comprising: providing a tube which is open adjacent an upper end of the tube; forming a column of said material in said tube; vaporizing a cryogenic liquid outside said tube and thereby generating a cooling gas; causing said gas to flow downwardly around said tube, then to be injected into said tube adjacent a base of said column and then to flow upwardly in said tube; and progressively extracting the material from a lower end of the tube by the effect of gravity.

2. A process according to claim 1, characterised in that it comprises regulating the supply of cryogenic liquid in such manner as to maintain the gas injected into the tube (1) at a given cold temperature.

3. A process according to claim 1, characterised in that it comprises extracting the cooled material (A) by successive charges and closing the lower end of the tube (1) between the periods of extraction.

4. A process according to claim 1, wherein said vaporizing step is performed by heat exchange between said cryogenic liquid and said downwardly flowing gas.

5. A process according to claim 4, wherein said cryogenic liquid is caused to flow upwardly during said vaporizing step.

6. A process according to claim 1, in which said liquid surrounds said downwardly flowing gas during vaporization of said liquid.

7. A process according to claim 1, wherein said tube is vertical.

8. A process according to claim 1, wherein said material is in the form of solid articles among which said gas flows upwardly in direct heat exchange relation.

9. A process according to claim 1, wherein said material is a loose solid material in bulk through which said gas flows upwardly in direct heat exchange relation.

10. A cooling tunnel for cooling material, comprising a tube which is open adjacent an upper end thereof to receive a column of said material in said tube, means for vaporizing a cryogenic liquid outside said tube and thereby generating a cooling gas, means causing said gas to flow downwardly around said tube, and then to be injected into said tube adjacent the base of said column and then to flow upwardly in said tube, and means for progressively extracting the material from the lower end of the tube by the effect of gravity.

11. A tunnel according to claim 10, characterized in that an intermediate chamber (7) closed at both ends is provided between the exchanger (3) and the tube (1), the exchanger (3) surrounding and being in heat exchange relation with said intermediate chamber (7) the outlet end of the exchanger being its upper end and opening onto this intermediate chamber.

12. A tunnel according to claim 11, characterised in that the intermediate chamber contains a packing (31) or baffles, preferably composed of a thermally conductive material.

13. A tunnel according to claim 10, characterised in that it comprises a temperature probe (17) adapted to detect the temperature of the cooling fluid in the region of said orifices (10), and an electrovalve (15) for controlling the supply of the cryogenic liquid to the exchanger (3) and controlled by this temperature probe.

14. A tunnel according to claim 13, characterised in that the electrovalve (15) is provided with a throttled by-pass (24).

15. A tunnel according to claim 10, characterised in that it comprises means (4) for closing the lower opening of the tube (1).

16. A tunnel according to claim 15, characterised in that said closing means (4) comprise means (21) for discharging successive charges of the cooled material.

17. A tunnel according to claim 16, characterised in that said closing means comprise a slide (21) movable between the lower end of the tunnel and a fixed guide plate (19) and defining an opening (22) which is, in a first position of the slide, in facing relation to the lower opening of the tube (1) and to a solid part of said plate (19) and which is, in a second position of the slide, in facing relation to an opening (20) in this plate.

18. A tunnel according to claim 17, for cooling a stack of bored parts (A), characterised in that the upper side of the slide (21) has grooving (23) which is in confronting relation to the tube (1) in said second position of the slide.

19. A tunnel according to claim 18, characterised in that the upper side of the guide plate (19) has grooving (23) located in vertical alignment with the tube (1).

20. A tunnel according to claim 16, for cooling a succession of individual parts (A), characterised in that it comprises means (27) for selectively retaining the lower part (A) in the vicinity of said orifices (10), and means (28) for selectively retaining the part (A) located immediately thereabove.

21. A tunnel according to claim 20, characterised in that the passage defined by the tube (1) is extended, with the same section, a given distance below said orifices (10).

22. A tunnel according to claim 10, characterised in that the axis X—X of the tube (1) is vertical.

23. A tunnel according to any claim 10, for the cooling of a succession of individual parts (A), characterised in that the section of the tube (1) matches the section of the parts (A) with a notable clearance.

24. A tunnel according to claim 26, and a heat exchanger (3) coaxial with said tube and disposed outside the latter, said exchanger comprising a conduit (13) an inlet end of which is connected to a source of cryogenic liquid and an outlet end of which communicates with the tube (1) through orifices (10) in the vicinity of the lower end of the tube.

* * * * *